United States Patent [19]

Pickett

[11] Patent Number: 4,842,240

[45] Date of Patent: Jun. 27, 1989

[54] CONDUIT POSITIONER FOR CONCRETE FORM STRUCTURE

[75] Inventor: James S. Pickett, Dekalb County, Ga.

[73] Assignee: PK Products, Inc., Conyers, Ga.

[21] Appl. No.: 87,413

[22] Filed: Aug. 20, 1987

[51] Int. Cl.[4] ..... E04F 17/08

[52] U.S. Cl. ..... 249/18; 52/98; 52/221; 52/699; 249/61; 249/83; 249/177; 249/183; 269/904; 285/64

[58] Field of Search ..... 249/39, 42, 61, 83, 249/91, 93, 94, 177, 183, 184, 188, 18; 52/98, 220, 221, 576, 577, 699, 701; 285/56, 64; 269/904

[56] References Cited

U.S. PATENT DOCUMENTS

| | | | |
|---|---|---|---|
| 2,775,017 | 12/1956 | McDonough | 249/83 |
| 3,160,175 | 12/1964 | Laemmle | 248/68.1 |
| 3,974,603 | 8/1976 | Vandegriff | 52/701 |
| 4,061,322 | 12/1977 | LeBlanc | 269/43 |
| 4,619,471 | 10/1986 | Harbeke | 52/221 |
| 4,629,155 | 12/1986 | Dula | 249/61 |
| 4,642,956 | 2/1987 | Harbeke | 52/221 |
| 4,748,787 | 6/1988 | Harbeke | 264/31 |

*Primary Examiner*—James Housel
*Attorney, Agent, or Firm*—Louis T. Isaf

[57] ABSTRACT

A conduit positioning and accessing apparatus, and resulting concrete form structure, comprises a compression type coupling, a flange member rigidly attached to the coupling, a filler element which removably surrounds a portion of the coupling and fastening elements for removably fastening the apparatus to a concrete form, wherein the filler element is formed of polystyrene foam or other easily disfigured material, and wherein an access cavity is defined in the hardened concrete upon removal of the form and filler element.

10 Claims, 2 Drawing Sheets

CONDUIT POSITIONER FOR CONCRETE FORM STRUCTURE

FIELD OF THE INVENTION

The present invention relates generally to the field of construction hardware and methods and, more specifically, to the field of electrical conduit assembly and construction in concrete structures.

BACKGROUND OF THE INVENTION

In the high rise construction business it is typical to construct multiple, spaced apart floors and/or multiple, spaced apart walls of concrete. It becomes necessary to provide electrical and other utility services from floor to floor or from room to room; and access from floor to floor or room to room can only be had through the concrete slabs. It is typical to bury conduit within the concrete slabs or to pass conduit through the concrete slabs. Both of these conduit arrangements cause difficulties in actual construction. When pouring wet concrete, it is necessry to construct form structures (such as wooden forms) to retain the wet concrete and define the edges of the concrete slab, such as the bottom or side edges. If the buried conduit is to exit the concrete slab at an edge defined by a form, some provision must be made to locate the end of the conduit at a particular location along the edge of the slab and to access the conduit once the form has been removed.

Various techniques and apparatus have been utilized in the past to provide placement of and access to the conduit end within the concrete slab. One example of a prior art structure is known as the "Concrete Form Structure" disclosed in U.S. Pat. No. 2,775,017 to B. F. McDonough. The McDonough invention found application on rigid conduit having ends which are threaded or can be threaded. However, rigid conduit is nearly a thing of the past. More flexible electrical metalic tubing ("EMT") is used in most construction and especially in cast-in-place concrete of the present day. The method and apparatus of McDonough are, relatively, very costly and impractical in most cases today.

When used in conjunction with EMT conduit, the McDonough device requires the addition of extra EMT connectors for adapting the McDonough device to the less flexible conduit, thus resulting in a relatively high cost in labor and material for production of the device. Furthermore, the prior art device results in labor intensive and costly (wasteful) installation.

SUMMARY OF THE INVENTION

Briefly described, the present invention comprises a conduit positioning and accessing apparatus comprised of a compression type coupling which is removeably fastened to a concrete mold or form (hereinafter called "form"). The apparatus of the present invention includes a flange member rigidly attached to the coupling and a donut shaped filler member which removeably surrounds a portion of the coupling. The flange member functions, in conjunction with nails or like fastening elements, to attach the compression coupling to the form (i.e. wooden form) at a desired location along the form. The flange member also functions in combination with the filler member and nails to hold the coupling and conduit at a desired angle relative to the form member. The filler member also serves to define a concrete free area surrounding a portion of the coupling.

In accordance with the method of the present invention, once the concrete hardens, the form member is pulled away from the concrete and away from the nails of the present apparatus. The nail ends are broken off and the filler member removed to reveal one end of the coupling device accessible within a cavity formed in the concrete.

Therefore, it is an object of the present invention to provide a relatively inexpensive and uncomplicated apparatus for assuring positioning of a conduit end along a concrete slab and for providing access to the conduit end within the concrete slab.

Another object of the present invention is to provide a labor minimizing method for positioning and retaining conduit ends within a concrete form during pouring of concrete and for accessing and extending conduit from the concrete slab after hardening of the concrete.

Yet another object of the present invention is to provide an access cavity, for access to a conduit buried within a concrete slab, which access cavity is quickly and easily varied in size and shape both prior to pouring and after pouring of concrete.

Other objects, features and advantages of the present invention will become apparant upon reading and understanding the present specification, when taken in conjunction with the accompanying drawings.

DETAILED DESCRIPTION OF THE PREFERRED EMBODIMENT

Figure 1:
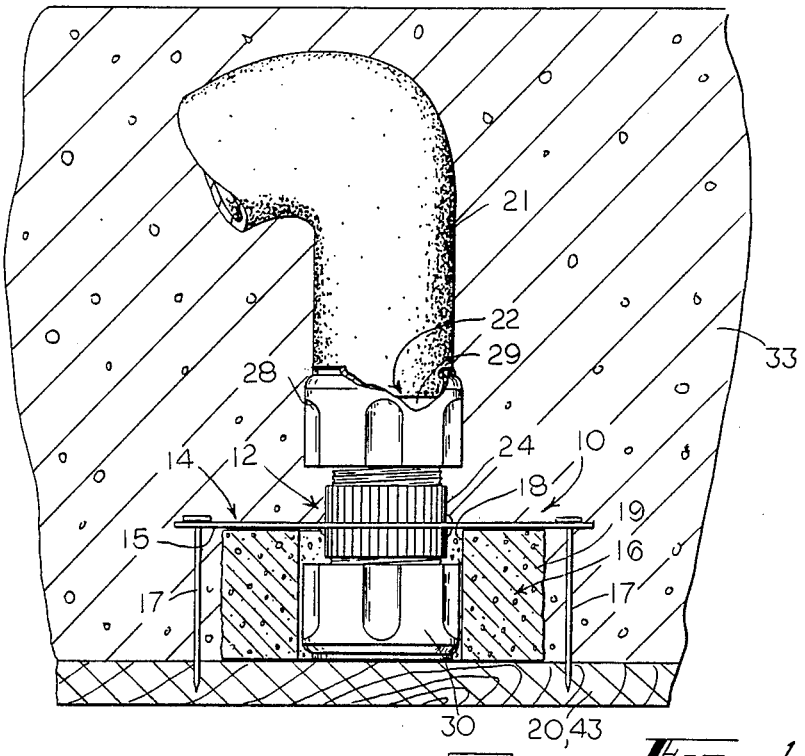
FIG. 1 is an isolated side view of the conduit positioning and accessing apparatus and resultant concrete forming structure, in accordance with the present invention.
Figure 2:
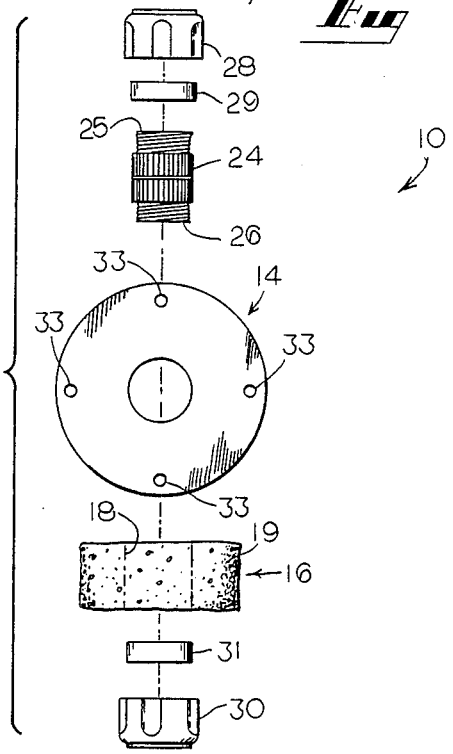
FIG. 2 is an exploded component view of the conduit positioning and accessing apparatus in accordance with the present invention.

Referring now in greater detail to the drawings in which like numerals represent like components throughout the several views, the conduit positioning and and accessing apparatus 10 in accordance with the present invention, is seen in FIG. 1 and FIG. 2 as including a coupling assembly 12, a flange member 14, a filler element 16 and a plurality of nails 17. In accordance with the present invention, the conduit positioning and accessing apparatus 10 is combined with a form member 20 and at least one section of conduit 21 to constitute an integral portion of a concrete form structure utilized to form a concrete slab during construction.

The coupling assembly 12 of the preferred embodiment is seen as including a coupling body 24 which is defined with external threading ends 25, 26. A compression washer 29 is placed at the top end 25 of the coupling body 24 and a compression nut 28 is placed over the washer and threaded to the top end. A second compression washer 31 is placed at the bottom end 26 of the coupling body 24 and a second compression nut 30 is then threaded onto the bottom end. This coupling assembly 12 of the preferred embodiment is an EMT compression type coupling functioning in a manner known in the art.

The flange member 14 is attached to the coupling body 24 at a location approximately mid-way between the two ends 25, 26 of the coupling body. The flange member 14 and coupling body 24 are, preferrably, rigidly attached, for example, cast as one piece or welded together, to define an integral component. The flange member 14 protrudes outward from the coupling body 24. In the preferred embodiment, the flange member is in the form of a flat, circular disk as shown. In the disclosed embodiment, a plurality of openings 33 are formed at the outer edges of the flange member 14 and the nails 17 (or screws or like devices) are placed through these openings. In the preferred embodiment, the filler element 16 is an easily removed and/or easily disintegrated material capable of occupying space and displacing wet concrete, such as foam rubber or polystyrene foam. The filler element 16 of the disclosed embodiment is a donut shaped piece of polystyrene foam having an inner passage 18 which fits snugly yet removeably about the bottom end 26 of the coupling assembly 12 (including the lower compression nut 30, if present), and having a body portion 19 of selectable height and thickness.

Assembly and Operation. Prior to the time the concrete is poured to form the concrete floor or wall slab 38, a form structure 41 (a portion of which is seen in FIG. 1) is assembled using form members 43 to define the bottom and edges of the future slab. For purposes of this discussion we will talk only of floor slabs 38. Within the "box" defined by the form members 43, conduit 21 is laid out in accordance with the respective plans to, eventually, be buried in concrete. The position is located along the form member 43 where the open end 22 of a conduit 21 is to be accessed through the concrete slab 38. The conduit positioning and accessing apparatus 10 is connected to the open end 22 of the conduit 21. The open end 22 of the conduit 21 is connected to the top end 25 of the coupling assembly 12 by action of the compression nut and washer 28, 29. With the conduit 21 connected to the top end 25 of the positioning and accessing apparatus 10 and the filler element 16 in place encircling the lower end 26 of the coupling assembly, the positioning and accessing apparatus 10 is placed against the form member 43 at the located position in the manner shown in FIG. 1. The bottom end 26 of the coupling assembly 12 is adjacent the form member 43 as is the bottom edge of the filler element 16. The nails 17 pass through the openings 33 and are nailed to the form member 43 (the form member of the disclosed embodiment being wood.). It can be seen that the positioning and accessing apparatus 10 of the present invention, when functioning in the mode shown in FIG. 1, is functioning in its "positioning mode". In this positioning mode, the coupling assembly functions to hold the conduit 21 in a fixed manner to the apparatus 10; the rigid coupling body 24 of the coupling assembly 12 functions to provide rigidity to the conduit 21 to thus better establish its location along the edge of the concrete when finally poured; the flange member 14 functions in conjunction with the nails 17 as a fastening and support member to retain the conduit end 22 accurately at the selected location; the filler element 16 assists in the support function of the flange member 14 and provides spacing for holding the wet concrete at a predefined distance from the bottom end 26 of the coupling assembly 12.

Figure 4:
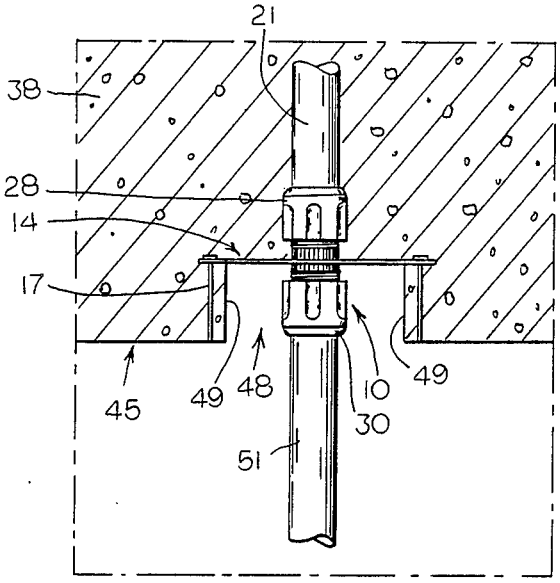
FIG. 4 is an isolated side view of the conduit positioning and accessing apparatus in its access mode, after concrete hardening.
Figure 3:
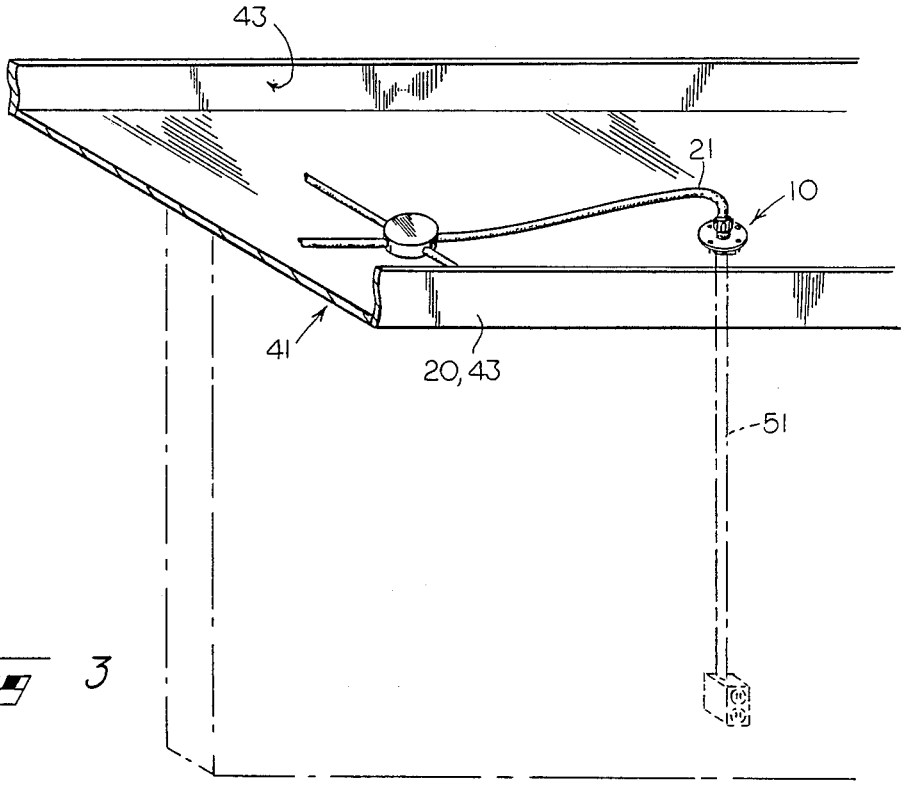
FIG. 3 is a pictorial representation of a portion of a building structure utilizing the present invention.

Once pouring has been accomplished and the concrete has harden, the form member 43 is pulled away from the concrete slab 38 as is typically performed in the industry. The form is thus pulled away from the nails 17 and any remaining, exposed ends of the nails are broken off by the user, flush against the concrete edge 45. Once the from member 43 has been removed, the location of the conduit can be easily spotted and the filler element 16 is simply pulled or picked away. As expressed above, the filler element 16 of the preferred embodiment is made of an easily destroyed, deformed or otherwise easily disfigured material such as polystyrene foam or foam rubber which can be picked away or pulled away with little effort. With reference to FIG. 4, once the form member 43 has been removed and the filler element 16 picked away, a cavity 48 remains in the general shape and size of the original filler element 16. It is seen that the positioning and accessing apparatus 10 remains embedded in the concrete slab 38 and, with its filler element 16 now removed, the apparatus functions in the "accessing mode" where access can now be had to the open end 22 of the conduit section 21 through the coupling assembly 12. Depending upon the requirements of the builder, either a second conduit 51 is connected to the bottom end 26 of the coupling assembly 12 through action of the compression nut and washer 30, 31 or the lower compression nut may be removed for connection of a fixture. Other uses will be understood by the reader.

It is within the scope of the present invention that the flange member 14 is not limited in shape to the disk shape disclosed herein. Rather, other shapes are acceptable so long as the flange member 14 performs the functions impliedly and expressly mentioned herein. Furthermore, a flange member 14 of preferred embodiments of the present invention operates in conjunction with the filler element 16 to define a cavity wherein the walls 49 of the cavity 48 are formed of concrete and not formed by the flange member itself. In this way, no special tools or special effort is required (as is in the case of the McDonough invention) to reach the concrete walls 49 of the cavity 48 if the walls 49 must be chipped away to enlarge the cavity. This function is accomplished in the disclosed embodiment by maintaining a spaced apart relationship between the form member 43 and all points of the flange member 14. See FIGS. 1 and 4.

Furthermore, it is understood that the particular size and shape of the filler element 16 is not to be limited by the disclosed embodiment. Rather, the size and shape are varied, in various embodiments, to define alternate sizes and shapes of the cavity 48; so long as the filler element 16 performs the functions impliedly and expressly attributed to it herein. Thus, whereas in the preferred embodiments, the filler element 16 is preformed at a specified size and shape, in accordance with alternate embodiments the present invention, the filler element 16 size and shape and, thus, the cavity 48 size and shape are definable and changeable at the job site immediately prior to installation of the apparatus 10 and pouring of concrete.

Whereas the present invention has been described in detail with reference to specific embodiments hereof, it will be understood that variations and modifications may be effected within the scope and spirit of the present invention as described before and defined in the appended claims.

I claim:

1. A conduit supporting and accessing apparatus for supporting conduit at a desired location relative to a form for concrete and for accessing the conduit within the hardened concrete after removal of the form, said apparatus comprising:

a conduit extension member including an externally threaded top portion and an externally threaded bottom portion;

a first compression nut and washer assembly threaded to said top portion of said extension member;

a second compression nut and washer assembly threaded to said bottom portion of said extension member;

a protruding member protruding from said extension member from between said first compression assembly and said second compression assembly, said protruding member defining a top side and a bottom side;

a filler element removably placed adjacent said bottom side of said protruding member, said filler element at least temporarily encircling said second compression nut and washer assembly and the segment of said extension member beneath said protruding member; and a plurality of openings defined through said protruding member for accepting fastening members.

2. Apparatus of claim 1, wherein said protruding member defines a flat disk rigidly fastened to said extension member.

3. Apparatus of claim 1, wherein said filler element is formed of readily disfigured material.

4. Apparatus of claim 1, wherein said filler element is selectively variable in size and shape.

5. Apparatus of claim 1, wherein said filler element is formed of polystyrene foam.

6. Concrete form structure, comprising:

a form member for retaining wet concrete to form a concrete slab, said form member being removable from the hardened concrete slab;

a conduit member for burial within concrete, said conduit member including an open end;

a compression coupling assembly connected to said open end of said conduit member, said coupling assembly comprising a conduit extension member including an externally threaded top portion and an externally threaded bottom portion, a first compression nut and washer assembly threaded to said top portion of said extension member, and a second compression nut and washer assembly threaded to said bottom portion of said extension member;

a protruding member attached to and protruding from said extension member from between said first compression assembly and said second compression assembly;

a plurality of openings defined through said protruding member for accepting fastening members;

a fastening member connecting said protruding member to said form member, said fastening member being breakable;

a filler element placed between said protruding member and said form member, said filler element at least temporarily encircling said second compression nut and washer assembly and the segment of said extension member beneath said protruding member, said protruding member being maintained by said filler element at a distance spaced apart from said form member, said filler element being independent of said protruding member and being removable from the hardened concrete slab, wherein wet concrete poured into the form structure is retained by said form member and hardens about said conduit member and said compression coupling assembly and wherein, after removal of said form member from the hardened concrete, said protruding member remains embedded in the concrete and said filler element is removed to provide access to said second compression nut and washer assembly.

7. Apparatus of claim 6, wherein said protruding member defines a flat disk rigidly fastened to said extension member.

8. Apparatus of claim 6, wherein said filler element is formed of readily disfigured material.

9. Apparatus of claim 6, wherein said filler element is selectively variable in size and shape.

10. Apparatus of claim 6, wherein said filler element is formed of polystyrene foam.

* * * * *